US007743946B2

(12) United States Patent
Edwards et al.

(10) Patent No.: US 7,743,946 B2
(45) Date of Patent: Jun. 29, 2010

(54) METHOD AND APPARATUS FOR SWITCHING FLOW CIRCUITS IN A PRODUCT DISPENSER

(75) Inventors: William A. Edwards, Selma, TX (US); Mauro C. Gonzalez, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 782 days.

(21) Appl. No.: 11/391,582

(22) Filed: Mar. 28, 2006

(65) Prior Publication Data

US 2007/0228075 A1 Oct. 4, 2007

(51) Int. Cl.
*B67D 5/56* (2006.01)

(52) U.S. Cl. ..... 222/129.1; 222/153.13; 222/153.14; 137/637.1; 137/625.4

(58) Field of Classification Search ... 222/129.1–129.4, 222/153.13, 153.14, 130, 132; 137/637.1, 137/602, 637, 625.4, 625.42, 625.17
See application file for complete search history.

(56) References Cited

U.S. PATENT DOCUMENTS 2,855,958 A * 10/1958 Welty et al. ..... 137/637
4,932,398 A * 6/1990 Lancaster et al. ..... 128/200.14
6,192,935 B1 2/2001 Schroeder ..... 137/625.41
6,286,721 B1 * 9/2001 Pellegrini ..... 222/129.1
6,698,621 B2 3/2004 Landers et al. ..... 222/129.1
2006/0071015 A1 * 4/2006 Jablonski et al. ..... 222/1

* cited by examiner

*Primary Examiner*—J. Casimer Jacyna
(74) *Attorney, Agent, or Firm*—Christopher L. Makay

(57) ABSTRACT

A switch over device provides a product dispenser with the capability to switch from a first diluent flow circuit to a second diluent flow circuit. The switch over device attaches to the dispenser, and includes a manifold having a first diluent inlet and a second diluent inlet in communication with a diluent outlet. The switch over device further includes a first and a second stem assembly, wherein the first and second stem assemblies are biased to a first position that interrupts flow from the first and second diluent inlets to the diluent outlet. In a second position, the stem assemblies permit fluid flow to the diluent outlet. The switch over device further includes actuators that enable an operator to easily switch from the one flow circuit to the other. The product dispenser may switch from virtually any type of diluent, and/or diluent temperatures, including ambient, chilled, and carbonated diluents.

11 Claims, 10 Drawing Sheets

METHOD AND APPARATUS FOR SWITCHING FLOW CIRCUITS IN A PRODUCT DISPENSER

BACKGROUND OF THE INVENTION

1. Field of the Invention

The present invention relates to product dispensing equipment and, more particularly, but not by way of limitation, to methods and an apparatus for switching from a first fluid line to a second fluid line without depressurizing the complete fluid system.

2. Description of the Related Art

Historically, the beverage dispensing industry revolved around the reconstitution of syrup concentrates with carbonated water. Consumers often were offered a multitude of soda flavors with a single non-carbonated option in a beverage dispenser. With changing philosophies in the areas of health and nutrition, product dispensing suppliers have been forced to offer a wider variety of products through basically the same interface, a beverage dispenser. Presently, it is common to see beverage dispensers delivering multiple non-carbonated beverages, such as lemonades, teas, sports drinks, and the like.

This changing trend has caused some challenges, as the life expectancy of a beverage dispenser is approximately seven to ten years. Many times older dispensers are not outfitted with product and diluent lines for every possible product valve combination. While newer beverage dispenser designs do take into consideration the possibility of switching between diluents, switching across two media paths provides the possibility of a leak across the switching mechanism, and a compromised mixture upon dispensing.

Similar considerations arise when switching from a chilled product to an ambient product, or the opposite. When utilizing a cold plate to chill product lines in a beverage dispenser, manufacturers are forced to commit fluid media flow paths to delivering either a chilled fluid or an unchilled fluid. Further, fluid lines must be committed to delivering either a carbonated fluid or an uncarbonated fluid. As the allocation of fluid paths is somewhat inflexible, changing of a product valve to deliver a chilled drink instead of an ambient drink, or a carbonated drink instead of an uncarbonated drink, may be difficult, or simply impossible. In most cases, the entire pressure system of the product fluids must be depressurized to manipulate product lines.

Accordingly, an apparatus that provides some flexibility in allowing customers to reconfigure the product valves of a product dispenser to deliver either chilled or ambient products on location without depressurizing the entire system would be beneficial to dispenser manufacturers, dispenser owners, as well as the producers of the product concentrates.

SUMMARY OF THE INVENTION

In accordance with the present invention, a switch over device provides a product dispenser with the capability to switch from delivering fluid from a first diluent flow circuit to a second diluent flow circuit for mixing with a concentrate. The switch over device includes a manifold having a first diluent inlet and a second diluent inlet in communication with a diluent outlet, and a concentrate inlet in communication with a concentrate outlet. The switch over device further includes a first stem assembly disposed in a first bore, and a second stem assembly in a second bore, wherein the first and second stem assemblies are biased to a first position that interrupts flow from the first and second diluent inlets to the diluent outlet. In a second position, the first and second stem assemblies permit fluid to flow from the first and second diluent inlets to the diluent outlet. The switch over device is mountable to a housing of a product dispenser, and may support a product dispensing valve. The switch over device further includes actuators that enable an operator to easily switch from the one flow circuit to the other. The actuators include a first engagement face and a second engagement face, wherein the first and second stem assemblies are in the first position when the first engagement face contacts the manifold, and further wherein, the first and second stem assemblies are in the second position when the second engagement faces are adjacent to the manifold. Accordingly, a product dispensing valve circuit may be changed from utilizing the first diluent circuit to utilizing the second diluent circuit without depressurizing the entire product dispenser.

The first diluent flow circuit and the second diluent flow circuit may deliver virtually any type of diluent, and diluent temperatures, including ambient diluents, chilled diluents, and carbonated diluents. The switch over device may also be used to deliver product concentrates, and full strength products to expand a product offering of a product dispenser. In an extension of the preferred embodiment, the switch over device is remotely activated.

It is therefore an object of the present invention to provide a switch over device that permits the selection between multiple flow circuits of a product dispenser.

It is a further object of the present invention to provide a product dispenser utilizing the switch over device, whereby a product valve may be switched from a first diluent flow circuit to a second diluent flow circuit.

It is still further an object of the present invention to provide a remotely activated switch over device, thereby enabling the product dispenser to be controlled from a command center.

It is still yet further an object of the present invention to provide a product dispenser that is able to switch between ambient diluents, chilled diluents, and carbonated diluents.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

Figure 1:
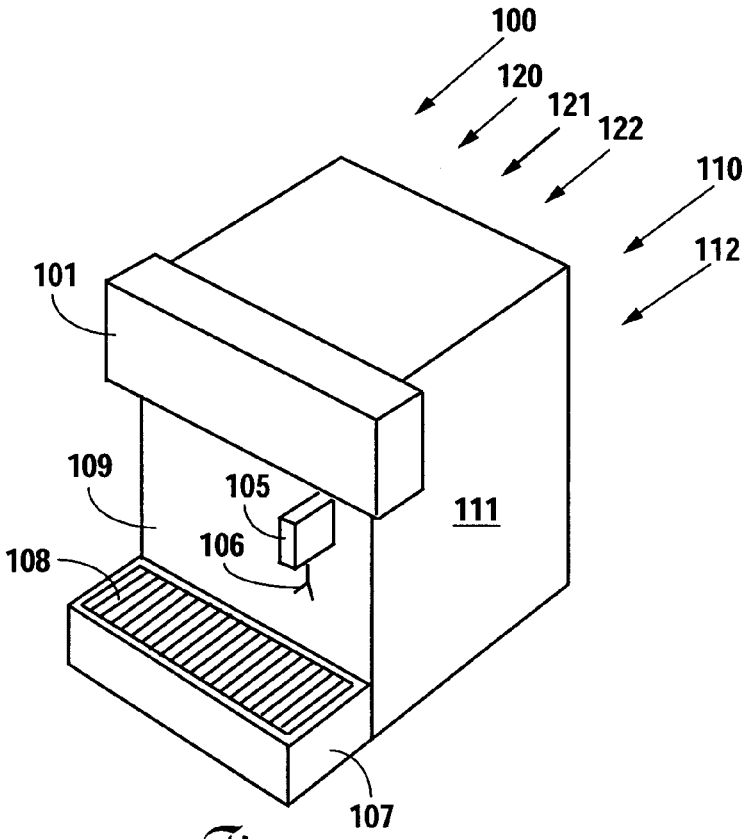
FIG. 1 provides an isometric view of a product dispenser according to a first embodiment.
Figure 2:
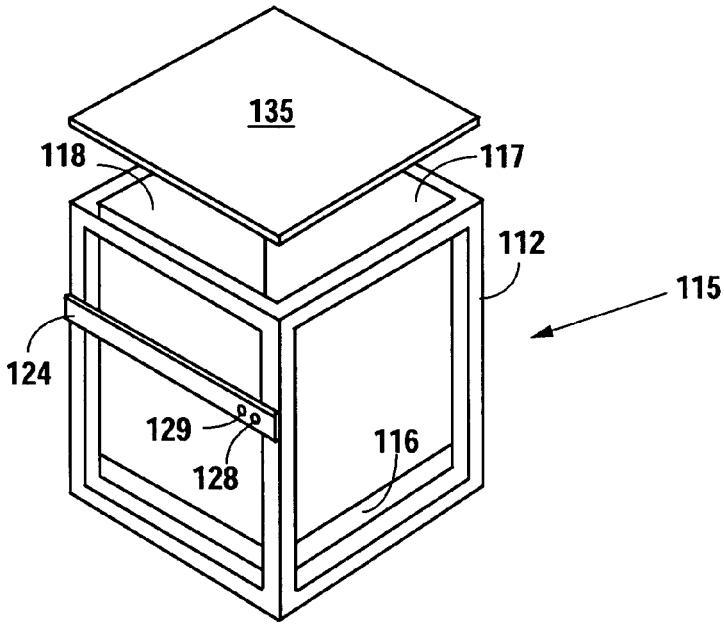
FIG. 2 provides an isometric view of interior components of the product dispenser according to the first embodiment.
Figure 3:
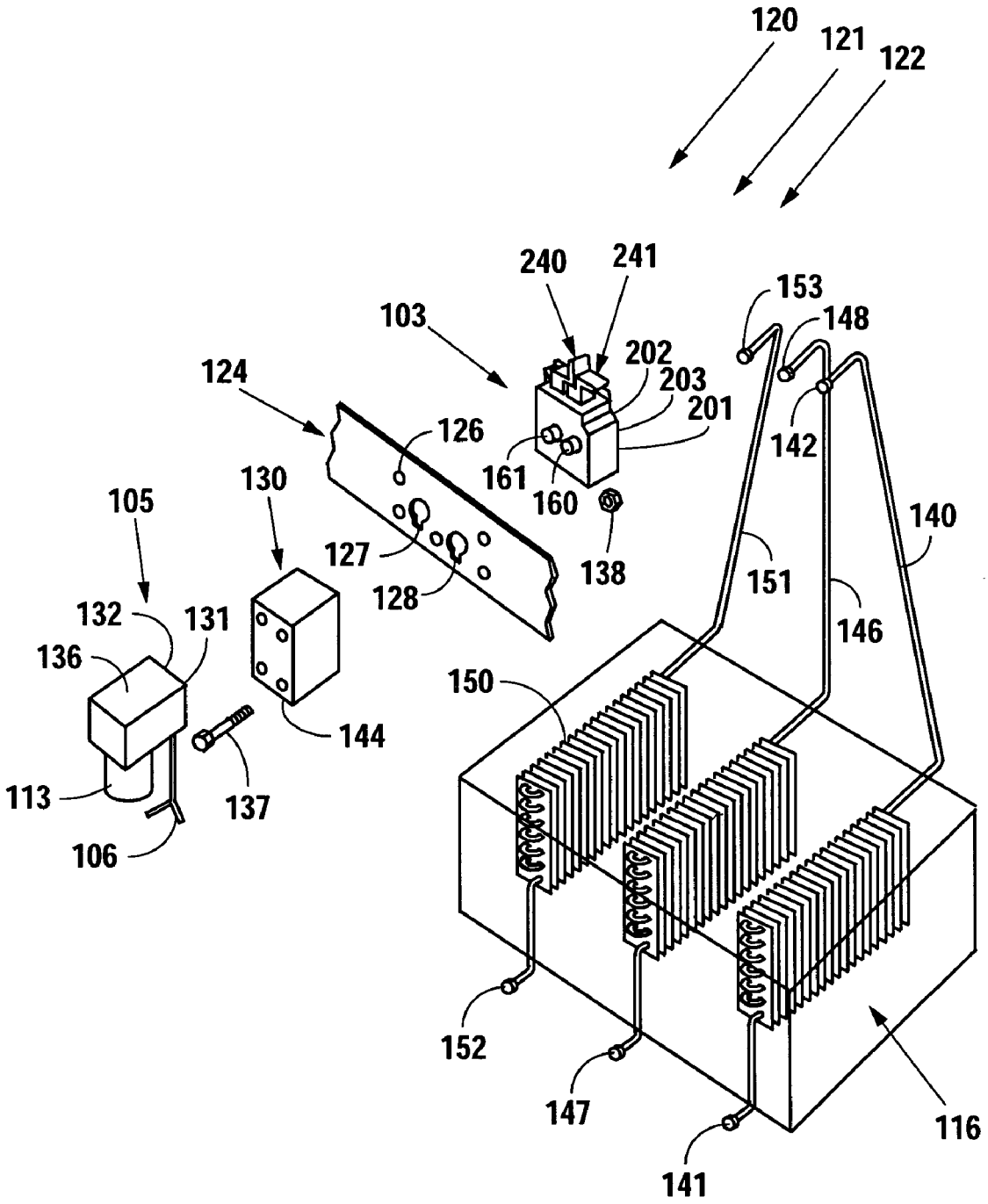
FIG. 3 provides an exploded view illustrating flow circuits according to the first embodiment.
Figure 4A:
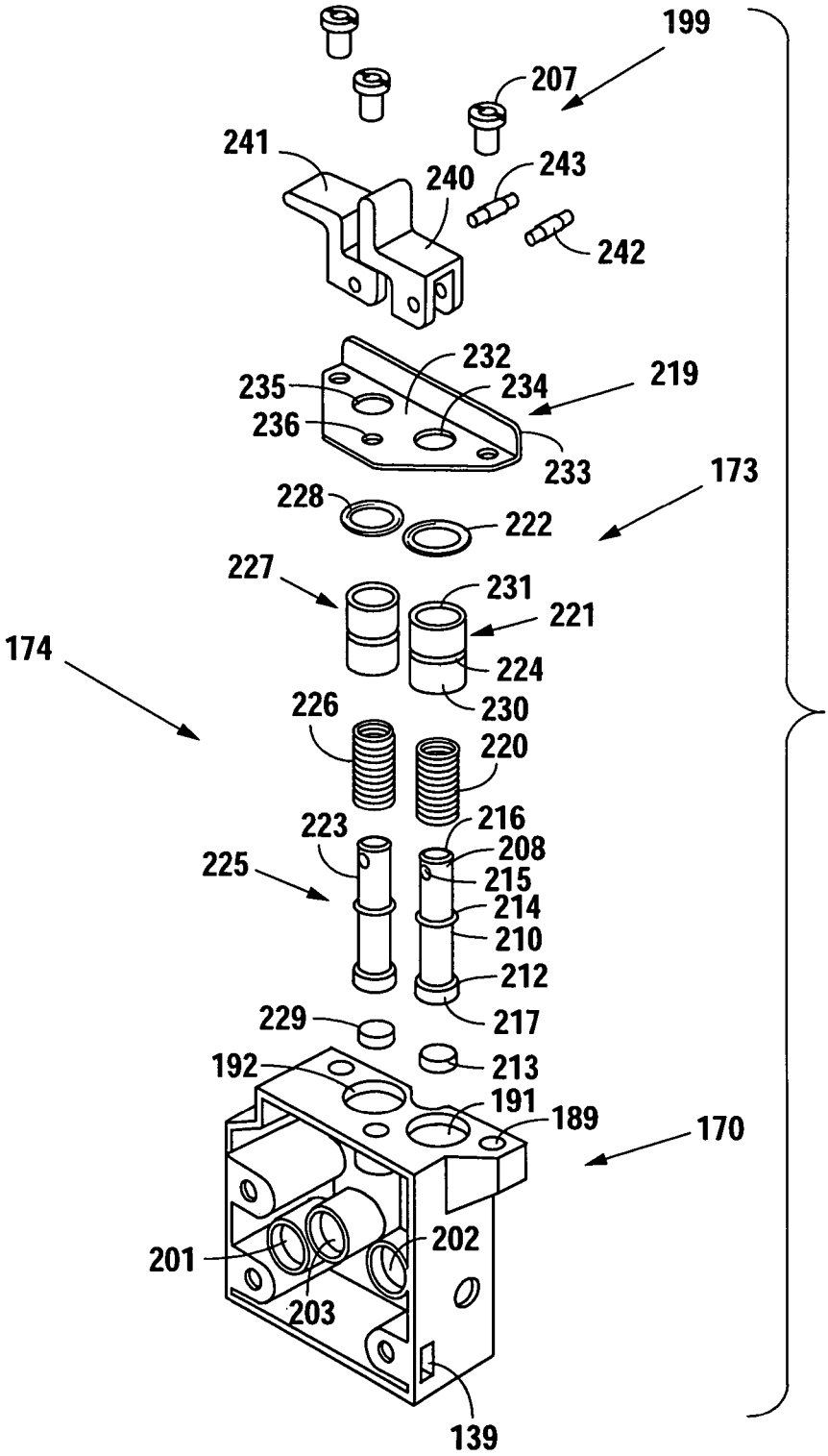
FIG. 4*a* provides an exploded view of a switch over device according to the first embodiment.
Figure 4B:
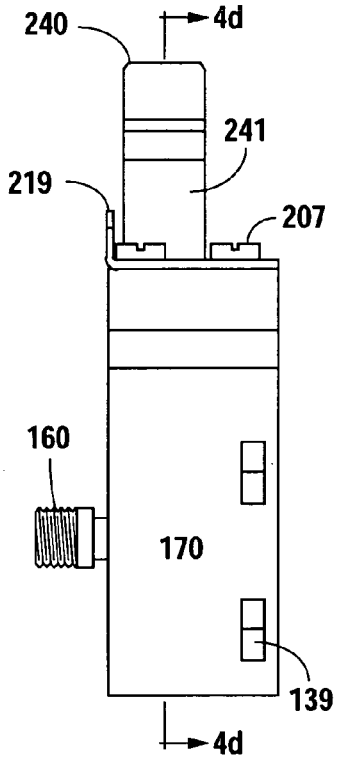
FIG. 4*b* provides a side view of the switch over device according to the first embodiment.
Figure 4D:
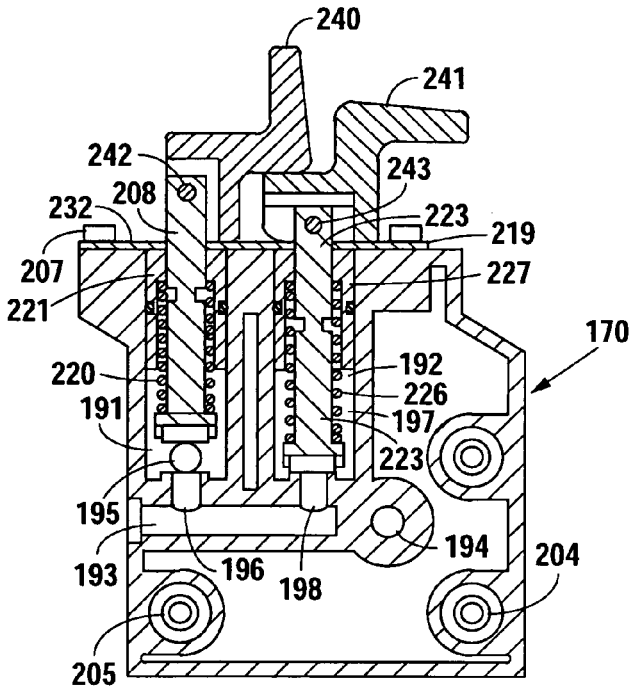
FIG. 4*d* provides a section view of the switch over device according to the first embodiment taken along line 4*d* to FIG. 4*b*.
Figure 4C:
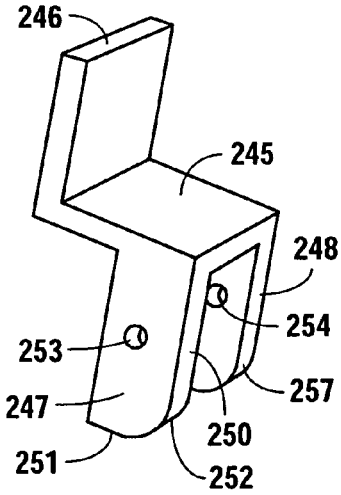
FIG. 4*c* provides a detail view of an actuator according to the first embodiment.

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

As shown in FIGS. 1-4*c*, a product dispenser 100 includes a housing 110, a first diluent flow circuit 120, a second diluent flow circuit 121, at least one switch over device 103, a concentrate flow circuit 122, and at least one product valve 105 secured to the housing 110. The housing 110 includes a frame assembly 112 enclosed by a wrapper 111. The frame assembly 112 may be of a rigid welded assembly, preferably of a steel, and may include a faucet plate 124 disposed on a front surface of the product dispenser 100. The faucet plate 124 includes at least one concentrate line alignment aperture 128, and at least one diluent line alignment aperture 129 disposed at a spacing that is complementary to a spacing between a concentrate inlet 131 and a diluent inlet 132 of the at least one product valve 105. The faucet plate 124 further includes valve mounting apertures 126 disposed at a predetermined spacing and size complementary to the mounting screws 137. The faucet plate 124 may include additional pairs of the alignment apertures 128 and 129, at a spacing consistent with the inlets 131 and 132, if more than one product valve 105 is utilized on the product dispenser 100.

The wrapper 111 closes out the sides and a rear portion of the frame assembly 112 to protect interior components of the product dispenser 100. The wrapper 111 may be of a sheet metal construction. Illustratively, the wrapper 111 may be constructed from stainless steel, aluminum, or the like. The product dispenser 100 further includes a drip tray 107 disposed at a lower end of a front of the housing 110, and below the at least one product valve 105. A splash plate 109 is mountable to the housing 110 above the drip tray 107 and below the product valve 105. The splash plate 109 is typically removable for cleansing and sanitizing. The product dispenser 100 further includes a cup rest 108 disposed within the drip tray 107. The cup rest 108 is sufficiently stable to support a cup placed onto the cup rest 108 during a filling operation. The product dispenser 100 may further include a marquis 101 disposed at an upper end of the front of the product dispenser 100. The marquis 101 closes out the area located above any product valves 105. The marquis 101 may be movable to provide access to an interior of the product dispenser 100.

The product dispenser 100 further includes a conditioning device 115. One of ordinary skill in the art will recognize that the conditioning device 115 may include a refrigeration circuit with a cold water bath, or the product lines may pass through a cold plate, such that the product lines are chilled when the temperature of the cold plate is maintained at a prescribed temperature. Illustratively, ice from the storage chamber may be placed onto the cold plate to remove heat from the cold plate. In this disclosure, the conditioning device 115 is a cold plate 116 disposed within the housing 110 and the frame assembly 112. The cold plate 116 is maintained at a prescribed temperature to chill products passing through product lines disposed within the cold plate 116.

The housing 110 further includes a liner 118 disposed above the cold plate 116, and within the frame assembly 112. The liner 118 defines a storage chamber 117 above the cold plate 116. The liner 118 may be of any form of food grade approved material, such as polyethylene. In this embodiment, the storage chamber 117 is designed to house ice for chilling beverages, as well as the cold plate 116. The housing 110 may further include an insulation 134 disposed between the wrapper 111 and about the storage chamber 117, such that the storage chamber 117 has insulative properties. The product dispenser 100 may further include a lid 135 utilized to close out the storage chamber 117.

The at least one product valve 105 is disposed on the front of the product dispenser 100 at a height both complementary to the height of the faucet plate 124. The at least one product valve 105 must further be of a height sufficient to allow clearance for a beverage receptacle to fit between the cup rest 108 and a nozzle 113 of the product valve 105. The product valve 105 may be any form of product valve commonly utilized in the dispensing industry to deliver a fluid or components for reconstituting the fluid, including mechanical valves, volumetric valves, electronic valves, and the like. The product valves 105 may be suitable for dispensing various types of fluids, including carbonated and uncarbonated beverages, juices, sodas, teas, sport drinks, and the like. The product valve 105 includes a body 130, a valve actuator 106, the nozzle 113, a cover 136, and mounting screws 137. The body 130 includes the concentrate inlet 131, the diluent inlet 132, and mounting apertures 144. The body 130 may be any form of body commonly utilized in the industry to accept fluids from product delivery lines to the nozzle 113, wherein actuation of the actuator 106 allows the selected product to flow through the body 130 to the nozzle 113. The actuator 106 may be any form of actuation device, including push buttons, electronic switches, levers, and the like. In this embodiment the actuator 106 is a lever.

In this disclosure, the term product dispenser 100 includes virtually any form of dispensing device that may or may not reconstitute a product. Illustratively, a product dispenser may deliver carbonated and uncarbonated beverages, juices, sodas, teas, sport drinks, and the like. As one of ordinary skill in the art will recognize, the product dispenser 100 may further dispense warm or ambient beverages, soups, condiments, sauces, or a mixture thereof.

The switch over device 103 includes a manifold 170, a stem control assembly 199, and fasteners 207. The manifold 170 includes a first bore 191, a second bore 192, an outlet chamber 193, and a concentrate passage 194. The first bore 191 includes a first inlet 195, and a first outlet 196. The second bore 192 includes a second inlet 197 and a second outlet 198. The outlet chamber 193 is in fluid communication with the first and second bores 191 and 192 through the first and second outlets 196 and 198. The outlet chamber 193 further includes a diluent outlet port 161 that includes a fitting suitable for communicating fluids. In this embodiment, the fitting on the diluent outlet port 161 is a dole fitting, however, one of ordinary skill in the art will recognize that other types of fittings may be utilized. The concentrate passage 194 includes a concentrate inlet 201 and a concentrate outlet 160. The concentrate inlet 201 is of a size suitable for accepting a dole fitting. The concentrate outlet 160 is of a design similar to the diluent outlet 161, such that common interface types are utilized at a connection point. The manifold 170 further includes a first diluent inlet 202 and a second diluent inlet 203. The first diluent inlet 202 is in fluid communication with the with the first inlet 195, and the second diluent inlet 203 is in fluid communication with the second inlet 197. The first and second diluent inlets 202 and 203 are of a size necessary to receive a dole fitting, thereby providing fluid communication between mating fitting and the first and second bores 191 and 192. The manifold 170 further includes mounting apertures 204, 205, and 206 for use in securing the manifold 170 to the product dispenser 100, and mounting apertures 189 disposed about the first and second bores 191 and 192. In this first embodiment, the manifold 170 is constructed from a nylon.

The stem control assembly 199 includes a first stem assembly 173, a second stem assembly 174, a restraint bracket 219, a first actuator 240, a second actuator 241, a first restraint pin 242, and a second restraint pin 243. The first stem assembly 173 includes a first stem 208, a first seal 213, and an o-ring 214. The first stem 208 is of a cylindrical shape, and includes first end 216, a second end 217, a flange 212, an o-ring groove 210, and a pivot aperture 215. The first seal 213 is disk shaped, and is permanently secured to the second end 217 of the first stem 208, such that the circular face of the first seal 213 mates with a circular face of the flange 212. The pivot aperture 215 is disposed at the first end 216 of the first stem 208. The o-ring groove 210 is disposed near a midpoint of the first stem 208, and is of a size complementary to the o-ring 214. The first stem 208 may be constructed from any food grade material, including polymers, stainless steels, or the like. Illustratively, the first stem 208 is constructed from a nylon. The seal 213 may be constructed from any food grade elastomers, including neoprene.

The first stem assembly 173 further includes a first spring 220, a bushing 221 and a bushing o-ring 222. The first spring 220 is of a diameter that fits within the first bore 191, and over the first stem 208 to engage the flange 212. The first spring 220 may be constructed from any food grade material, including stainless steels. The bushing 221 is cylindrical in shape, and includes an outer periphery 230 and an inner periphery 231. The bushing 221 may be constructed from virtually any food grade polymer. Illustratively, the bushing 221 may be constructed from acetal, nylon, or acetal butyl styrene. The bushing 221 further includes an o-ring groove 224 that is complementary in size to the bushing o-ring 222.

The second stem assembly 174 is identical to the first stem assembly 173, and includes a second stem 223, a second seal 229, a second o-ring 225, a second spring 226, a second bushing 227, and a second bushing o-ring 228. All functions and features of the second stem assembly 174 are identical to the first stem assembly 173.

The restraint bracket 219 is of a sheet metal construction, and includes a planar face 232, a flange 233, a first stem aperture 234, a second stem aperture 235, and restraint apertures 236. As the restraint bracket 219 is not exposed to food contact, it may be formed from virtually any type of sheet metal, including steels, stainless steels, aluminum, or even polymers. The first and second stem apertures 234 and 235 are of a size complementary to size of the first end 216 of the stems 208 and 223, and of a spacing consistent with the spacing between the first and second bores 191 and 192. The restraint apertures 236 are of a size complementary to the fasteners 207, and of a spacing consistent with the mounting apertures 189 of the manifold 170.

The actuators 240 and 241 are identical to each other in shape and function. The actuators 240 and 241 include a planar body 245, a perpendicular protrusion 246, a first leg 247, and a second leg 248. The protrusion 246 is of a width complementary to the body 245. The first leg 247 extends in a plane perpendicular to the body 245 and opposite to protrusion 246, and includes a first pivot aperture 253. The second leg 248 mirrors the first leg 247, and extends from the body 245 parallel to the first leg 247. The second leg 248 is offset from the first leg 247 at a distance complementary to the diameter of the first end 216 of the stem 208, and includes a second pivot aperture 254. The first and second pivot apertures 253 and 254 are collinear. The actuators 240 and 241 further include a first engagement face 250, a second engagement face 251, a first transition arc 252, and a second transition arc 257.

The first engagement face 250 extends from the first leg 247, across the body 245, and to the second leg 248. The second engagement face 251 likewise extends from the first leg 247, across the body 245, and to the second leg 248. The transition arcs 252 and 257 terminate at the first engagement face 250 and the second engagement face 251.

The restraint pins 242 and 243 are cylindrical in shape, and of a diameter complementary to the diameter of the first and second pivot apertures 253 and 254 of the actuators 240 and 241. The restraint pins 242 and 243 are further of a length complementary to the width of the actuators 240 and 241. The restraint pins 242 and 243 may be constructed from virtually any material suitable for shear applications. Illustratively, the restraint pins 242 and 243 may be of a metallic construction, such as those metals found in spring pins, dowel pins, or bolts.

The first diluent flow circuit 120 includes a first diluent line 146 having an inlet 147, and an outlet 148. The first diluent line 146 further includes coils disposed within the cold plate 116, whereby the cold plate 116 chills a fluid disposed within the first diluent line 146 as it flows from the inlet 147 to the outlet 148. In this first embodiment, the first diluent line 146 is in communication with a first diluent source.

The second diluent flow circuit 121 includes a second diluent line 151 having an inlet 152, and an outlet 153. The second diluent line 151 further includes coils disposed within the cold plate 116, whereby the cold plate 116 chills a fluid disposed within the second diluent line 151 as it flows from the inlet 152 to the outlet 153. In this first embodiment the second diluent flow circuit 121 further passes through a carbonator 150 that may be disposed within the cold plate 116, thereby further carbonating the fluid disposed within the second diluent line 151. In this first embodiment, the inlet 152 of the second diluent flow circuit 121 is in fluid communication with a second pressurized diluent source, whereby the diluent moves from the inlet 152 to the outlet 153.

The concentrate flow circuit 122 includes a concentrate line 140 having an inlet 141 and an outlet 142. The concentrate line 140 includes coils that are disposed within the cold plate 116, whereby the fluid disposed within the concentrate line 140 is chilled while it passes through the cold plate 116. In this first embodiment, the concentrate line 140 is in fluid communication with a concentrate source.

Assembly of the switch over device 103 commences with the assembly of the first and second stem assemblies 173 and 174. A seal 213 is permanently secured to the second end 217 of the first stem 208. Assembly continues with the installation of an o-ring 214 into the o-ring groove 210. Next the spring 220 is placed over the first stem 208, and is lowered until it bottoms out on the flange 212. An o-ring 222 is then installed into the groove 224 of the bushing 221. The bushing 221 is then placed over the first stem 208, and forced downward against the spring 220 pressure. The first stem assembly 173 is then inserted through the first stem aperture 234 of the restraint bracket 219, such that the flange 233 faces away from the first stem assembly 173. Assembly continues with the alignment of the stem assembly 173 such that the pivot aperture 215 is perpendicular to the flange 233.

The first actuator 240 is then placed over the first end 216 of the first stem 208 such that the second engagement face 251 is nearest the planar face 232 and a midplane of the restraint bracket 219. The first end 216 is disposed between the first leg 247 and the second leg 248. The pivot aperture 215 of the first stem 208 may then be aligned with the first and second pivot apertures 253 and 254 of the first actuator 240. Once aligned, the first restraint pin 242 is inserted through the pivot apertures 253, 254, and 215. Once inserted, the first stem assembly 173 is permanently affixed to the restraint bracket 219. The first actuator 240 may then be pivoted toward the first engagement face 250 about the first restraint pin 242 to move the first engagement face 250 onto the planar face 232 of the restraint bracket 219.

The second stem assembly 174 may be assembled in a manner similar to the first stem assembly 173, however, the second actuator 241 will be positioned in a direction opposite to that of the first actuator 240. Once the stem assemblies 173 and 174 have been assembled onto the restraint bracket 219, the stem control assembly 199 may be attached to the manifold 170. Attachment commences with the insertion of the second end 217 of the first stem 208 into the first bore 191, and the insertion of the second end of the second stem 223 into the second bore 192. The stem control assembly 199 is then fully inserted into the bores 191 and 192, and the fasteners 207 are inserted into the mounting holes 189 in the manifold 170. The insertion of the stem assembly 173 into the first bore 19 creates a closed chamber in the first bore 191, as the bushing o-ring 222 creates a seal between the bushing 221 and an inner periphery of the first bore 191, and the o-ring 214 creates a seal between the first stem 208 and the inner periphery 231 of the bushing 221. Further, when the first engagement face 250 of the first actuator 240 is against the planar face 232 of the restraint bracket 219, the spring 220 forces the first stem 208 downward such that the seal 213 covers the outlet 196 leading to the outlet chamber 193. In this first position, the first diluent flow circuit 120 ends in the first bore 191.

Similarly to the first bore 191, the insertion of the second stem assembly 174 into the second bore 192 creates a closed chamber in second bore 192. With the first engagement face 250 of the second actuator 241 mated to the planar face 232 of the restraint bracket 219, the second spring 226 forces the second stem 223 downward such that the second seal 229 covers the second outlet 198. In this position, the second diluent flow circuit 121 ends in the second bore 192.

Assembly of the product dispenser 100 commences with a cold plate 116 including the first diluent line 146, the second diluent line 151, and the concentrate line 140 being placed into the frame assembly 112. The liner 118 is then placed into the frame assembly 118 above the cold plate 116, thereby forming the storage chamber 117. The build up continues with the application of insulation to the outer surfaces of the liner 118, thereby providing insulative properties to the liner 118 and the storage chamber 117. The switch over device 103 may then be installed onto the faucet plate 124 by inserting the diluent outlet 161 through the diluent line alignment aperture 129, and the concentrate outlet 160 through the concentrate line alignment aperture 128. Once diluent outlet 161 and the concentrate outlet 160 are through the apertures 128 and 129, the switch over device 103 may be moved downward to lock the diluent outlet 161 and the concentrate outlet 160 into the reduced width slots, thereby locking the switch over device 103 in place.

At this point, the outlet 148 of the first diluent line 146 may be inserted into the first diluent inlet 202 of the switch over device 103, thereby extending the first diluent flow circuit 120 through to the first bore 191. The outlet 153 of the second diluent line 151 is then inserted into the second diluent inlet 203 of the switch over device 103, thereby extending the second diluent flow circuit 121 through to the second bore 192. Finally, the outlet 142 of the concentrate line 140 may be inserted into the concentrate inlet 201 of the switch over device 103, thereby extending the concentrate flow circuit 122 through to the concentrate passage 194 of the switch over device 103.

The body 130 of the product valve 105 may then be installed onto the faucet plate 124, such that the diluent inlet 132 of the body 130 connects with the diluent outlet 161 of the switch over device 103, and the concentrate outlet 131 of the body 130 mates with the concentrate outlet 160 of the switch over device 103. Once aligned and mated with the outlets 160 and 161, mounting screws 137 may be inserted through the mounting apertures 144 of the body 130. The mounting screws 137 extend through the body 130, the valve mounting apertures 126 of the faucet plate 124, and partially through the mounting apertures 204 of the manifold 170. Mounting nuts 138 are then disposed in depressions 139 of the manifold 170, such that the mounting screws 137 engage the mounting nuts 139 to secure the product valve 105 to the switch over device 103 and the faucet plate 124. The cover 136 may then be installed onto the product valve 105.

The frame assembly 112 may further be closed out by installing the wrapper 111, the lid 135, the drip tray 107, and the splash plate 109. Assembly of the product dispenser 100 continues with the installation of the marquis 101 and the cup rest 108.

On final assembly, with the actuators in a lowered or closed position, the first diluent flow circuit 120 is defined by the first diluent line 146, the first diluent inlet 202, and the first bore 191, and the second diluent flow circuit 121 is defined by the second diluent line 151, the second diluent inlet 203, and the second bore 192.

In operation, the first or second diluent flow circuits 120 or 121 may be extended to the product valve 105 by rotating the first actuator 240 or the second actuator 241 about the applicable restraint pin 242 or 243 to raise a respective stem assembly 173 or 174. Rotation of an actuator 240 or 241 such that the second engagement face 251 is adjacent to the planar face 232 of the restraint bracket 219 raises the respective stem assembly 173 or 174, and moves the seal 213 or 229 away from the outlet 196 or 198. Upon the seal 213 or 229 being removed from the outlet 196 or 198, the respective bore 191 or 192, is in fluid communication with outlet chamber 193. Upon the first actuator 240 being raised to an open position, the first diluent flow circuit 120 is extended, and includes the first diluent line 146, the first diluent inlet 202, the first bore 191, the outlet chamber 193, the diluent outlet 161, and the valve diluent inlet 132 for delivery through the nozzle 113. In this embodiment, the first diluent flow circuit 120 passes through the cold plate 116 for conditioning.

Alternatively, the raising of the second actuator 241 to the open position extends the second diluent flow circuit 121, and includes second diluent line 151, the second diluent inlet 203, the second bore 192, the outlet chamber 193, the diluent outlet 161, and the valve diluent inlet 132 for delivery through the nozzle 113. In this embodiment, the second diluent flow circuit 121 passes through a carbonator and a cold plate 116 for conditioning.

In this first embodiment the concentrate flow circuit 122 is coupled to a concentrate source, and includes the concentrate line 140, the concentrate inlet 201, the concentrate passage 194, the concentrate outlet 160, and the concentrate inlet 131 of the product valve 105 for delivery through the nozzle 113. The concentrate flow circuit 122 passes through the switch over device 103 uninhibited, as the concentrate passage 194 does not include shutoffs.

The actuators 140 and 141 are designed such that only one actuator 140 or 141 may be in the open position at a time, thereby ensuring that a mixture of the fluids in the first diluent flow circuit 120 and the second diluent flow circuit 121 do not simultaneously deliver fluid to the outlet chamber 193, and into an operator's cup. The "or" condition is dictated by an actuator 140 or 141 in an open position extending into the path of an additional actuator attempting to rotate into the open position. Accordingly, three distinct flows may be delivered in this first embodiment. Illustratively, a combination of a chilled diluent with a concentrate may be delivered to the valve, or a combination of a carbonated and chilled diluent with a concentrate may be delivered to the product valve 105, or only a concentrate may be delivered to the valve 105 if both actuators 240 and 241 are in a closed position. One of ordinary skill in the art will recognize that concentrate, in this disclosure includes both single strength products, concentrated products, and the like.

Figure 5:
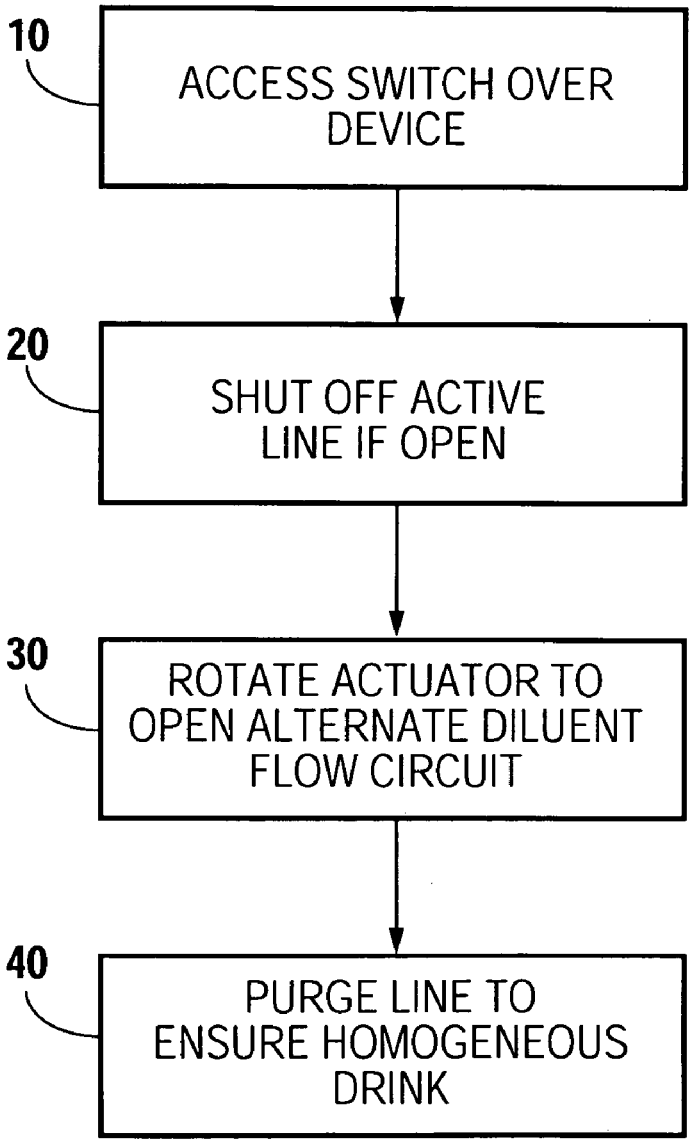
FIG. 5 provides a method flowchart illustrating the process of switching a product valve from a first product line to a second product line according to the first embodiment.

In use, an operator may switch the product dispenser 100 from utilizing the first diluent flow circuit 120 in conjunction with the concentrate flow circuit 122 to utilizing the second diluent flow circuit 121 with the concentrate flow circuit 122 without depressurizing the entire product dispenser 100. As shown in the method flow chart of FIG. 5, the process commences with step 10, wherein the operator must access the switch over device 103 by either rotating or removing the cover of the product valve 105, or rotating or removing the marquis 101. Once accessed, the operator must rotate the first actuator 240 to the first position, wherein the first engagement face 250 is adjacent to the planar face 232 of the restraint bracket 219, step 20. Upon rotation of the first actuator 240 to the first position, the first bore 191 is separated from the outlet chamber 193, thereby removing the outlet chamber 193 and all the fluid paths beyond the outlet chamber 193 from the first diluent flow circuit 120. Next, the operator must rotate the second actuator 241 from the first position to the second position, such that second engagement face 251 is adjacent to the planar face 232 of the restraint bracket 219, as shown in step 30. With the second actuator 241 in the second position, the second bore 192 is connected to the outlet chamber 193, and the second diluent flow circuit 121 is extended to include the outlet chamber 193, the diluent outlet 161, the diluent inlet 132 to deliver fluid through the nozzle 113 when the valve actuator 106 is activated. The process continues with step 40, wherein the operator must purge the newly connected product line, thereby ensuring delivery of a homogeneous dispense.

In a second embodiment, a product dispenser 300 is substantially identical to the product dispenser 100, and accordingly, like parts have been annotated with like numerals. However, the first and second diluent flow circuits 120 and 121 of the product dispenser 100 have been replaced with a first diluent flow circuit 320 that delivers a carbonated and chilled fluid, and a second flow circuit 321 that delivers an unconditioned fluid to the switch over device 103 for delivery to the product valve 105.

Figure 6:
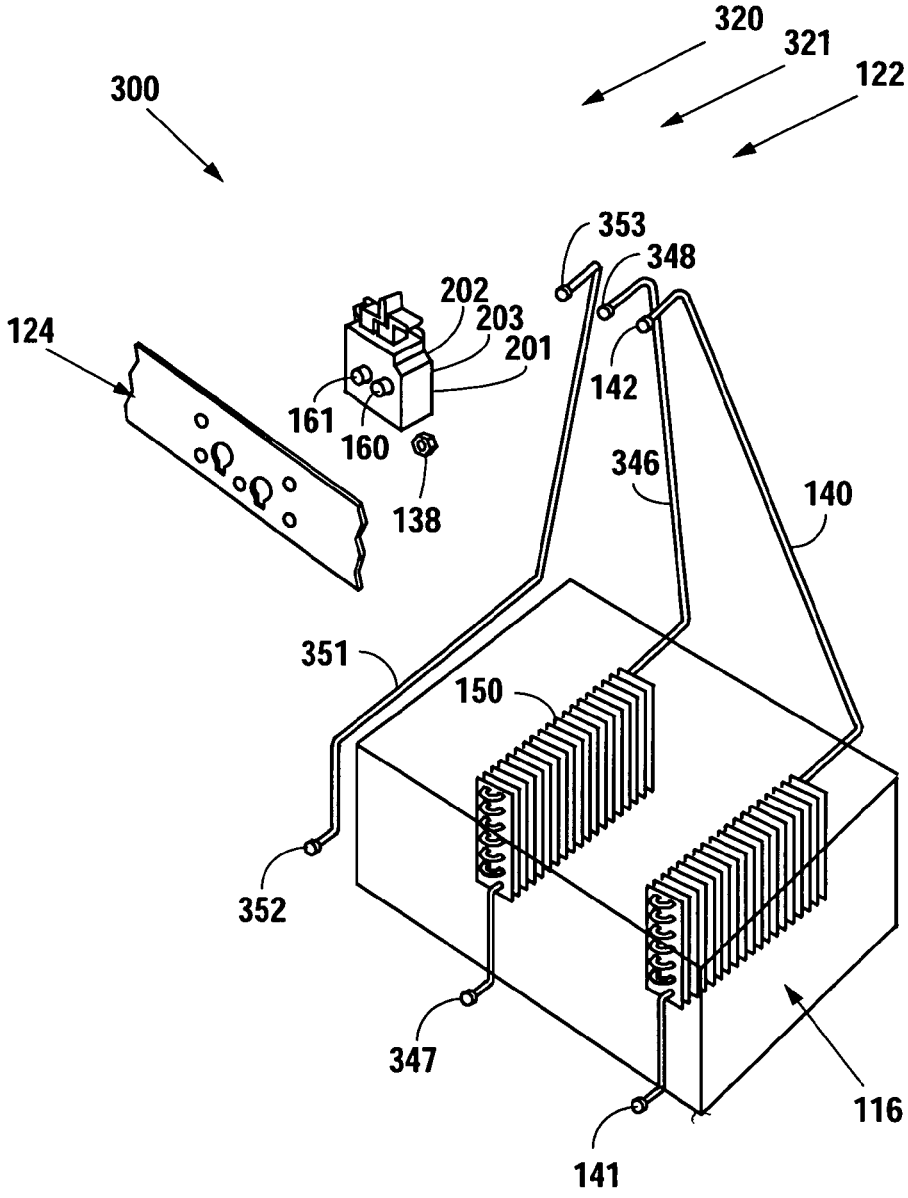
FIG. 6 provides an isometric view illustrating a setup for switching a product valve from a carbonated and chilled product to an uncarbonated ambient product according to a second embodiment.

As shown in FIG. 6, the product dispenser 300 includes the first diluent flow circuit 320, the second diluent flow circuit 321, and the concentrate flow circuit 122. The first diluent flow circuit 320 includes a first diluent line 346 having an inlet 347 and an outlet 348. The first diluent line 346 passes through the cold plate 116 and the carbonator 150, such that fluid disposed within the first diluent line 346 is conditioned as it passes through the cold plate 116 and the carbonator 150. The outlet 348 of the first diluent line 346 connects to the first diluent inlet 202 of the switch over device 103, such that any fluid disposed within the first diluent line 346 may be delivered to the first diluent inlet 202 and the first bore 191.

The second diluent flow circuit 321 includes a second diluent line 351 having an inlet 352 and an outlet 353. The second diluent line 351 does not pass through the carbonator or the cold plate 116, and therefore, is not conditioned. The inlet 352 of the second diluent line 351 is coupled to a diluent source, and the outlet 353 is coupled to the second diluent inlet 203 of the switch over device 103. As such, a fluid disposed within the second diluent line 351 may be delivered from the diluent source to the second diluent inlet 203 and the second bore 192.

The concentrate flow circuit 122 of this second embodiment is identical to the concentrate flow circuit 122 of the first embodiment, and includes a concentrate line 140 having an inlet 141 and an outlet 142. The first concentrate line 140 passes through the cold plate 116 for conditioning. The inlet 141 of the first diluent line 146 is coupled to a concentrate source, and the outlet of the concentrate line 140 is coupled to the concentrate inlet 201 of the switch over device 103. Accordingly, the concentrate flow circuit 122 delivers a conditioned fluid to the concentrate passage 194 of switch over device 103.

In use, the product dispenser 300 may utilize a diluent from the first diluent flow circuit 320 when the first actuator 240 is in the second position, or from the second diluent flow circuit 321 when the second actuator 241 is in the second position. The product dispenser 300 is therefore able to deliver a chilled and carbonated diluent in combination with a chilled concentrate, or an ambient, uncarbonated diluent in combination with the chilled concentrate.

In a third embodiment, a product dispenser 350 is substantially identical to the product dispensers 100 and 300, and accordingly, like parts have been annotated with like numerals. However, the first and second diluent flow circuits of the product dispensers have been replaced with a first diluent flow circuit 420 that delivers an uncarbonated and chilled fluid, and a second flow circuit 421 that delivers an unconditioned fluid to the switch over device 103 for delivery to the product valve 105.

Figure 7:
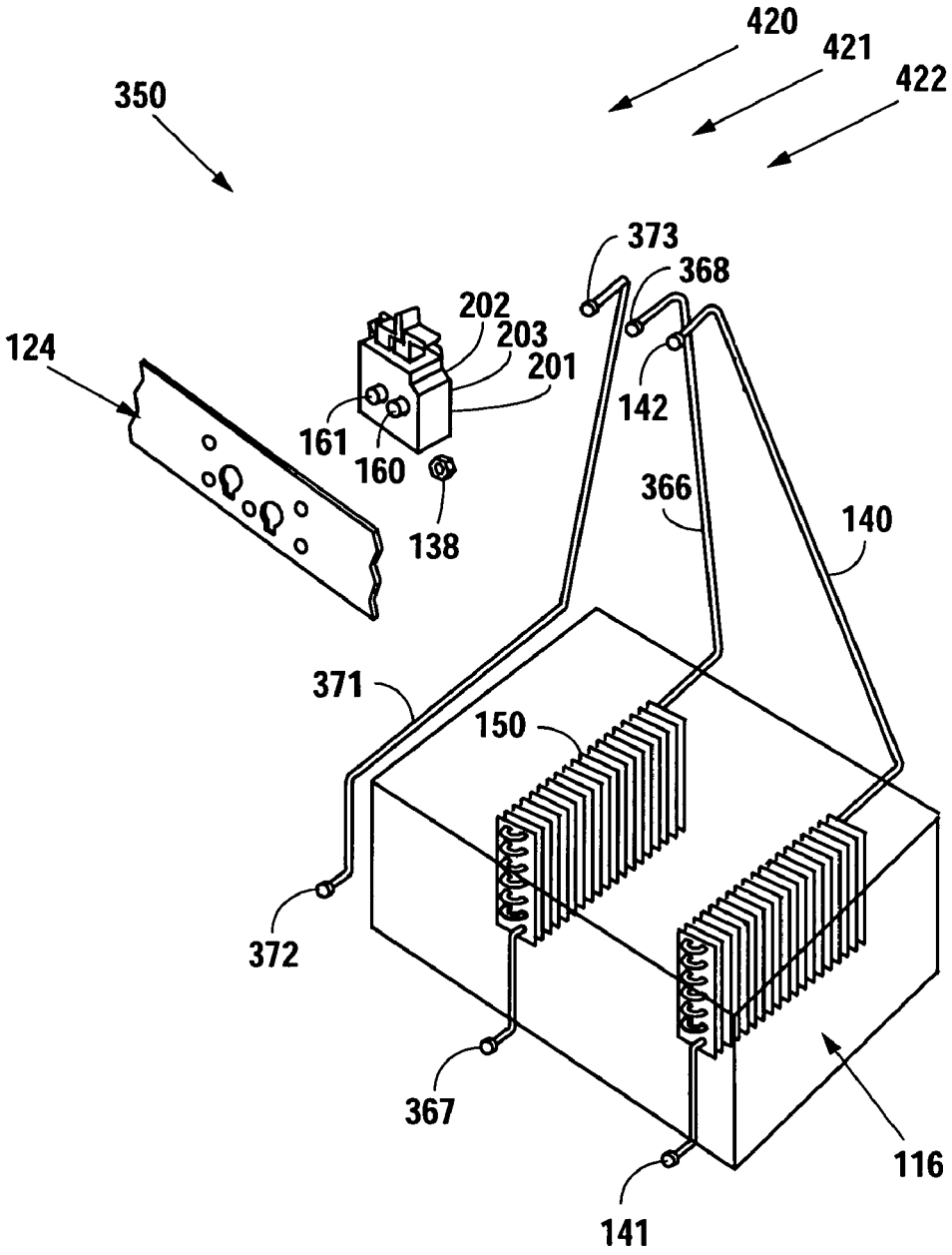
FIG. 7 provides an isometric view illustrating a setup for switching from an uncarbonated ambient product to an uncarbonated chilled product according to a third embodiment.

As shown in FIG. 7, the product dispenser 350 includes the first diluent flow circuit 420, the second diluent flow circuit 421, and the concentrate flow circuit 122. The first diluent flow circuit 420 includes a first diluent line 366 having an inlet 367 and an outlet 368. The first diluent line 366 passes through the cold plate 116, such that fluid disposed within the first diluent line 366 is conditioned as it passes through the cold plate 116. The outlet 368 of the first diluent line 366 connects to the first diluent inlet 202 of the switch over device 103, such that any fluid disposed within the first diluent line 366 may be delivered to the first diluent inlet 202 and the first bore 191.

The second diluent flow circuit 421 includes a second diluent line 371 having an inlet 372 and an outlet 373. The second diluent line 371 does not pass through the carbonator or the cold plate 116, and therefore, is not conditioned. The inlet 372 of the second diluent line 371 is coupled to a diluent source, and the outlet 373 is coupled to the second diluent inlet 203 of the switch over device 103. As such, a fluid disposed within the second diluent line 371 may be delivered from the diluent source to the second diluent inlet 203 and the second bore 192.

The concentrate flow circuit 122 of this third embodiment is identical to the concentrate flow circuit 122 of the first and second embodiments, and includes a concentrate line 140 having an inlet 141 and an outlet 142. The first concentrate line 140 passes through the cold plate 116 for conditioning. The inlet 141 of the first diluent line 146 is coupled to a concentrate source, and the outlet of the concentrate line 140 is coupled to the concentrate inlet 201 of the switch over device 103. Accordingly, the concentrate flow circuit 122 delivers a conditioned fluid to the concentrate passage 194 of switch over device 103.

In use, the product dispenser 350 may utilize a diluent from the first diluent flow circuit 420 when the first actuator 240 is in the second position, or from the second diluent flow circuit 421 when the second actuator 241 is in the second position. The product dispenser 350 is therefore able to deliver a chilled diluent in combination with a chilled concentrate, or an ambient, uncarbonated diluent in combination with the chilled concentrate.

One of ordinary skill in the art will recognize that the first and second flow circuits from the first, second, and third embodiments may be utilized in conjunction with each other when more than one product valve 105 is utilized on a product dispenser. Accordingly, multiple product valves 105 may be utilized with multiple switch over devices 103 to deliver varying types of diluents to a respective product valve 105. One of ordinary skill in the art will further recognize that the use of switch over devices 103 on a product dispenser 100 is not limited to diluent flow circuits. Concentrate flow circuits may also utilize a switch over device 103 to expand the product offerings of the product dispenser 100, thereby providing the ability to switch between chilled and ambient concentrate flow circuits.

Figure 8A:
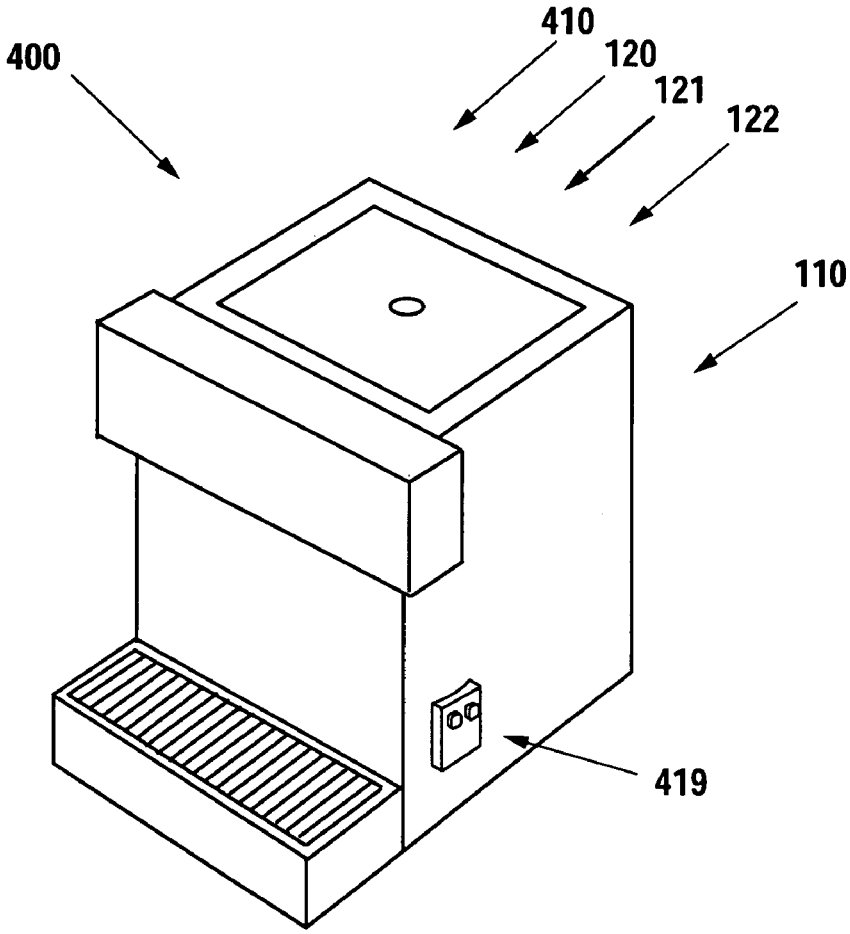
FIG. 8*a* provides an isometric view of a product dispenser including a control system according to a fourth embodiment.
Figure 8B:
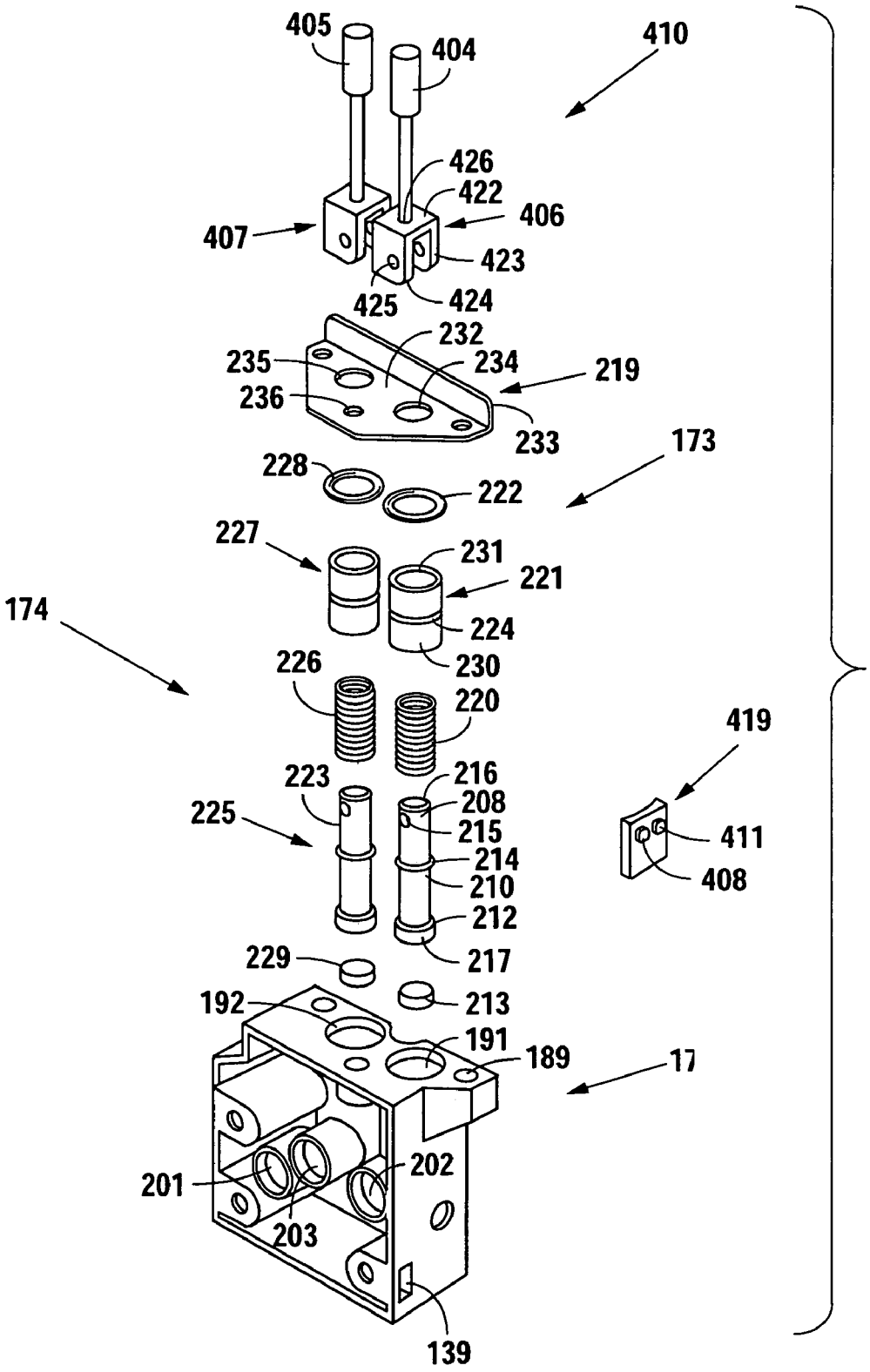
FIG. 8*b* provides an exploded view of a switch over device according to the fourth embodiment.

In a fourth embodiment, a product dispenser 400 is substantially identical to the product dispensers 100, 300, and 350, however, the product dispenser 400 further includes a control system 410 that remotely activates a switch over device 403. As shown in FIG. 8*a-b*, the product dispenser 400 includes the first diluent circuit 120, the second diluent circuit 121, and the concentrate circuit 122. The control system 410 includes a controller 419, an input device 408, an output device 411, a first solenoid 404, a second solenoid 405, a first adapter 406, and a second adapter 407.

The switch over device 403 is identical to the switch over device 103, however, the first actuators 240 is replaced with the first adapter 406, and the second actuator 241 is replaced with the second adapter 407. The first adapter 406 includes a planar body 422, a first leg 423, and a second leg 424. The first leg 423 and the second leg 424 lie parallel to each other, and are perpendicular to the planar body 422, such that the legs 423 and 424 and the body 422 form a u-shape. Each leg includes an aperture 425 for receiving the restraint pin 242 or 243. The planar body 422 includes an aperture 426 for connection to the solenoids 404 or 405.

The first solenoid 404 includes a shaft that fastens to the aperture 426 of the planar body 422 of a respective first or second adapter 406 or 407. The shaft may be secured to the adapter 406 utilizing any known method, including threads, e-clips, fasteners, and the like. The first solenoid 404 is further secured to the housing 110 of the product dispenser 400, such that the first solenoid 404 pulls the shaft through first solenoid 404 when activated. The second solenoid 405 is identical to the first solenoid 405, and is similarly secured. The input device 408 may be any form of device capable of receiving a signal or selection command from an operator, including, LCD panels, pushbuttons, or the like. The output device 411 may be any form of signal output device, including readable text on an LCD screen, audio devices, and the like, wherein the controller 419 is able to output a signal to an operator.

The controller 419 is a microprocessor based controller, and is in electrical communication with the first solenoid 404, the second solenoid 405, the output device 411, and the input device 408, such that signals may be received from an operator through the input device 408, and processed to effect a switch from a flow circuit in use to a different flow circuit.

Assembly of the switch over device 403 is substantially identical to the switch over device 103, however, the actuators 240 and 241 are replaced with the first adapter 405 and the second adapter 406. The first and second stem assemblies 173 and 174 are still oriented in the same direction, and the restraint pins 242 and 243 are placed through the aligned apertures 406 and the pivot aperture 215. Once connected the switch over device 403 may be mounted to the product dispenser 400. Once secured to the product dispenser 400, the first and second solenoids 404 and 405 may be secured to the housing 110, and then secured to the respective adapters 406 or 407.

Upon full assembly, the solenoids 404 and 405 each include two positions, a position equivalent to the first position of the product dispenser 100, and the second position of the product dispenser 100. As previously disclosed, the first position of the switch over device 103 provides for the stem assemblies 173 and 174 being forced downward by the springs 220 and 226, thereby forcing the first seal 213 to face off on and cover the first outlet 196, and the second seal 229 to face off on and cover the second outlet 198, thereby ceasing the flow of fluid through the first and second outlets 196 and 198. In this fourth embodiment, the first position is coincident with the solenoids 404 and 405 not being activated.

In the second position, coincident with a single solenoid 404 or 405 being activated, a single stem assembly 173 or 174 is raised to move the respective seal 213 or 229 off of the first or second outlet 196 or 198, thereby extending the flow circuit to the product valve 105. Accordingly, activating the first solenoid 404 extends the first diluent circuit 120 to the product valve 105, and activating the second solenoid 405 extends the second diluent circuit 121 to the product valve 105. As shown in the first embodiment, only a single diluent flow circuit should be extended at a time, as the extension of both diluent flow circuits 120 and 121 will lead to a non homogenous dispense. As such, the controller 419 must ensure that only one diluent flow circuit 120 or 121 is extended at a time.

Figure 8C:
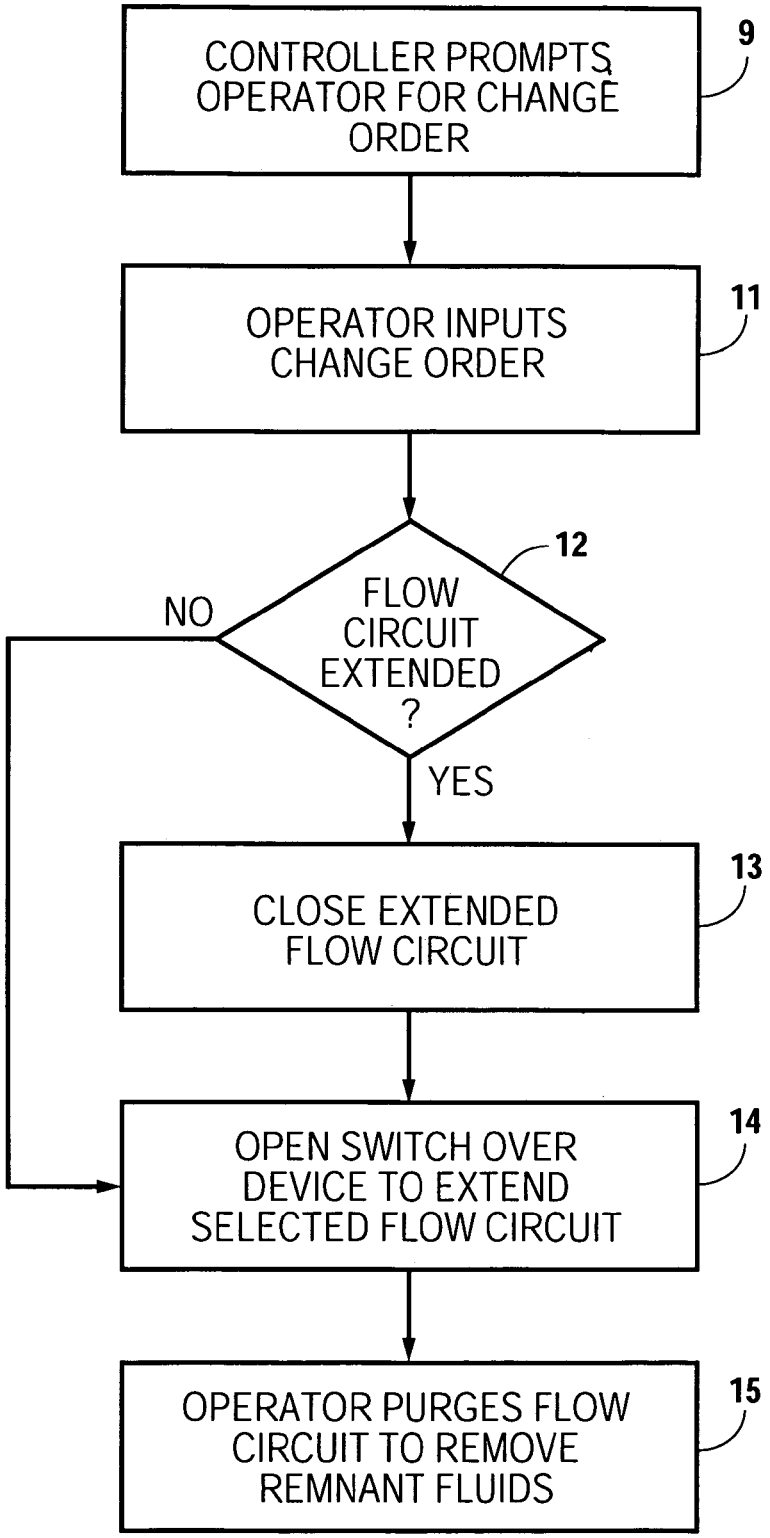
FIG. 8*c* provides a method flow chart illustrating the process of switching from a first flow circuit to a second flow circuit according to the fourth embodiment.

FIG. 8*c* provides a method flowchart illustrating the steps of changing from a current fluid flow circuit to an alternate flow circuit according to the fourth embodiment. The process commences with step 9, wherein the controller 419 prompts an operator for a change order input. Next, step 11, an operator inputs a change flow circuit command to the input device 408. The controller 419 then moves to step 12 to determine if a flow circuit is currently extended. If a flow circuit is currently extended, the controller 419 closes the currently extended flow circuit by deactivating the activated solenoid 404 or 405, step 13. Once all activated solenoids for the product valve 105 are deactivated, the controller 419 activates the respective solenoid for the desired flow circuit extension, as shown in step 14. If a flow circuit is not currently extended for the product valve 105 in step 12, then the controller 419 moves to step 14 to activate the solenoid for the desired flow circuit extension. After the flow circuit has been extended, the operator must purge the newly extended flow circuit to remove any remnant diluent, thereby ensuring a homogeneous dispense, step 15.

While this fourth embodiment has been shown with a product dispenser 400 including a control system 410, that controls and operates the product dispenser 400 and the switch over device 403, one of ordinary skill in the art will recognize that the control system 410 may be utilized with the switch over device 403, yet not include the product dispenser 400. Operation of the switch over device 403 without the product dispenser 400 may be possible by including the control system 410. In this arrangement, the switch over device 403 could be connected to product sources or diluent sources as desired. The control system 410 could then direct the movement from a first position to a second position, and the movement from the second position to the first position. thereby regulating the flow of fluids, as previously described, through the switch over device 403. Additional framework may be required to mount the switchover device 403, the solenoids 404 and 405, as well as other associated components.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A switch over device for a product dispenser, comprising:

a manifold including:

a concentrate inlet communicating with a concentrate outlet adapted for communication with a concentrate inlet of a product valve, a first diluent inlet, a second diluent inlet, a diluent outlet adapted for communication with a diluent inlet of a product valve, an outlet chamber communicating with the diluent outlet, a first bore in communication with the first diluent inlet and the outlet chamber, and a second bore in communication with the second diluent inlet and the outlet chamber;

a first stem assembly disposed within the first bore, wherein the first stem assembly in a first position seals the first bore to interrupt communication between the first diluent inlet and the diluent outlet and in a second position opens the first bore to permit communication between the first diluent inlet and the diluent outlet; and a second stem assembly disposed within the second bore, wherein the second stem assembly in a first position seals the second bore to interrupt communication between the second diluent inlet and the diluent outlet and in a second position opens the second bore to permit communication between the second diluent inlet and the diluent outlet, further wherein the second stem assembly must be in its first position for the first stem assembly to be moved into its second position and the first stem assembly must be in its first position for the second stem assembly to be moved into its second position.

2. The switchover device according to claim 1, wherein the first stem assembly comprises:

a first seal disposed within the first bore, wherein the seal is biased over a passage leading to the outlet chamber when the first stem assembly is in the first position, thereby ceasing the flow from the first bore to the outlet chamber.

3. The switch over device according to claim 2, wherein the second stem assembly comprises:

a second seal disposed within the second bore, wherein the second seal is biased over a passage leading to the outlet chamber when the second stem assembly is in the first position, thereby ceasing the flow from the second bore to the outlet chamber.

4. The switch over device according to claim 3, further comprising:

a first spring biasing the first stem assembly to the first position, thereby interrupting communication from the first diluent inlet to the diluent outlet; and a second spring biasing the second stem assembly to the first position, thereby interrupting communication from the second diluent inlet to the diluent outlet.

5. The switchover device according to claim 4, further comprising:

a first actuator rotatably coupled to the first stem assembly, the first actuator including a first engagement face and a second engagement face, wherein the spring biases the first stem assembly to the first position when the first engagement face bears against the manifold, and further wherein the first stem assembly moves to the second position when the first actuator rotates to a position wherein the second engagement face bears against the manifold.

6. The switchover device according to claim 5, further comprising:

a second actuator rotatably coupled to the second stem assembly, the second actuator including a first engagement face and a second engagement face, wherein the second spring biases the second stem assembly to the first position when the first engagement face bears against the manifold, and further wherein the second stem assembly moves to the second position when the second actuator is rotated to a position wherein the second engagement face bears against the manifold.

7. The switchover device according to claim 6, wherein a portion of an actuator in the second position extends into the path of the adjacent actuator, such that the actuator cannot rotate from the first position to the second position, thereby preventing the possibility of two actuators in the second position, and the flow of two different diluents to the diluent outlet.

8. A switch over device for a product dispenser, comprising:

a manifold including:

a concentrate inlet communicating with a concentrate outlet adapted for communication with a concentrate inlet of a product valve, a first diluent inlet, a second diluent inlet, a diluent outlet adapted for communication with a diluent inlet of a product valve, an outlet chamber communicating with the diluent outlet, a first bore in communication with the first diluent inlet and the outlet chamber, and a second bore in communication with the second diluent inlet and the outlet chamber;

a first stem assembly disposed within the first bore, wherein the first stem assembly in a first position seals the first bore to interrupt communication between the first diluent inlet and the diluent outlet, and in a second position opens the first bore to permit communication between the first diluent inlet and the diluent outlet;

a second stem assembly disposed within the second bore manifold, wherein the second stem assembly in a first position seals the second bore to interrupt communication between the second diluent inlet and the diluent outlet, and in a second position opens the second bore to permit communication between the second diluent inlet and the diluent outlet;

a first actuator rotatably coupled to the first stem assembly, the first actuator including a first engagement face and a second engagement face, wherein when the first actuator is rotated to a position such that the first engagement face bears against the manifold the first stem assembly moves to the first position, and further wherein when the first actuator is rotated to a position such that the second engagement face bears against the manifold the first stem assembly moves to the second position;

a second actuator rotatably coupled to the second stem assembly, the second actuator including a first engagement face and a second engagement face, wherein when the second actuator is rotated to a position such that the first engagement face bears against the manifold the second stem assembly moves to the first position, and further wherein when the second actuator is rotated to a position such that the second engagement face bears against the manifold the second stem assembly moves to the second position; and a portion of an actuator in the second position extends into the path of the adjacent actuator such that the actuator cannot rotate from the first position to the second position, thereby preventing the possibility of two actuators in the second position and the flow of two different diluents to the diluent outlet.

9. The switchover device according to claim 8, wherein the second stem assembly must be in its first position for the first stem assembly to be moved into its second position and the first stem assembly must be in its first position for the second stem assembly to be moved into its second position.

10. The switchover device according to claim 8, wherein the first stem assembly comprises:

a first seal disposed within the first bore, wherein the seal is biased over a passage leading to the outlet chamber when the first stem assembly is in the first position, thereby ceasing the flow from the first bore to the outlet chamber.

11. The switch over device according to claim 10, wherein the second stem assembly comprises:

a second seal disposed within the second bore, wherein the second seal is biased over a passage leading to the outlet chamber when the second stem assembly is in the first position, thereby ceasing the flow from the second bore to the outlet chamber.

* * * * *